US005379967A

United States Patent [19]

Shachar

[11] Patent Number: 5,379,967

[45] Date of Patent: Jan. 10, 1995

[54] DAY/NIGHT OPTICAL GUIDING APPARATUS

[75] Inventor: Zohar Shachar, Haifa, Israel

[73] Assignee: State of Israel Ministry of Defense Armament Development Authority Rafael, Haifa, Israel

[21] Appl. No.: 55,707

[22] Filed: Apr. 30, 1993

[51] Int. Cl.[6] ..... F41G 7/00

[52] U.S. Cl. ..... 244/3.16

[58] Field of Search ..... 244/3.16, 3.15, 3.14, 244/3.13; 364/424.02, 423, 462; 372/65

[56] References Cited

U.S. PATENT DOCUMENTS

| | | | |
|---|---|---|---|
| 2,144,425 | 1/1939 | Cook | 428/472.2 |
| 3,962,537 | 6/1976 | Kearns et al. | 244/3.14 |
| 4,274,609 | 6/1981 | Ferrier et al. | 244/3.14 |
| 4,733,609 | 3/1988 | Goodwin et al. | 244/3.16 |
| 4,862,257 | 8/1989 | Ulich | 348/31 |
| 4,964,721 | 10/1990 | Ulich et al. | 250/332 |
| 4,991,183 | 2/1991 | Meyers | 372/65 |
| 5,013,917 | 5/1991 | Ulich | 250/330 |

FOREIGN PATENT DOCUMENTS

| | | |
|---|---|---|
| 2622995 | 12/1977 | Germany . |
| 3029294 | 2/1982 | Germany . |
| 3113404 | 10/1982 | Germany . |
| 3338479 | 5/1985 | Germany . |
| 67597 | 12/1982 | Israel . |
| 81988 | 3/1987 | Israel . |
| 2144524 | 3/1985 | United Kingdom . |

*Primary Examiner*—Daniel T. Pihulic
*Attorney, Agent, or Firm*—Helfgott & Karas

[57] ABSTRACT

A day/night guided weapon including a chassis, apparatus for providing guided driving of the chassis, an intensified CCD camera mounted on the chassis for providing optical target acquisition under reduced light condition and a high intensity light source mounted on the chassis for providing illumination of a desired area.

15 Claims, 2 Drawing Sheets

DAY/NIGHT OPTICAL GUIDING APPARATUS

FIELD OF THE INVENTION

The present invention relates generally to a guided weapon.

BACKGROUND OF THE INVENTION

Weapons equipped with homing systems employing TV or other optical seekers are often handicapped by the fact that when lighting conditions are poor, the seekers may not be able to distinguish a target from its surroundings.

SUMMARY OF THE INVENTION

The present invention seeks to extend the operational capabilities of optical target acquisition systems for use under reduced lighting conditions.

There is therefore provided, in a preferred embodiment of the invention, a day/night guided weapon system, preferably an airborne weapon, employing an optical homing apparatus, the system including a chassis, apparatus for providing guided driving of the chassis, an intensified CCD camera especially suited for use under reduced lighting conditions, mounted on the chassis, for providing optical target acquisition and a high intensity light source mounted on the chassis for providing illumination of a desired area.

Additionally the apparatus may include a retractable platform mounted on the chassis for mounting auxiliary guiding or target acquisition equipment.

In accordance with a preferred embodiment of the invention the high intensity light source is mounted on the retractable platform.

In accordance with a preferred embodiment of the invention the retractable platform is retractable so as to reduce drag on the guided weapon, to protect the high intensity light source and/or to facilitate orientation of the platform.

In a preferred embodiment of the invention the weapon also includes an extending mechanism associated with the retractable platform and apparatus for activating the extending mechanism of the retractable platform according to commands. In a particular preferred embodiment of the invention, the extending mechanism of the retractable platform is operative for extending the platform when the target scene illuminance falls below a predetermined level.

Preferably the weapon includes apparatus for activating the high intensity light source according to commands. In a particularly preferred embodiment of the invention the light source is activated when the target scene illuminance falls below a predetermined level.

In a preferred embodiment of the invention the weapon also includes a second camera adapted for tracking during daylight.

Preferably the apparatus for activating the high intensity light source includes apparatus for directing the high intensity light source towards the bearing of at least one camera. Alternatively, the light source can be directed away from the target for deception purposes.

BRIEF DESCRIPTION OF THE DRAWINGS

The present invention will be understood and appreciated from the following detailed description taken in conjunction with the drawings in which.

DETAILED DESCRIPTION OF THE PREFERRED EMBODIMENT

Figure 1:
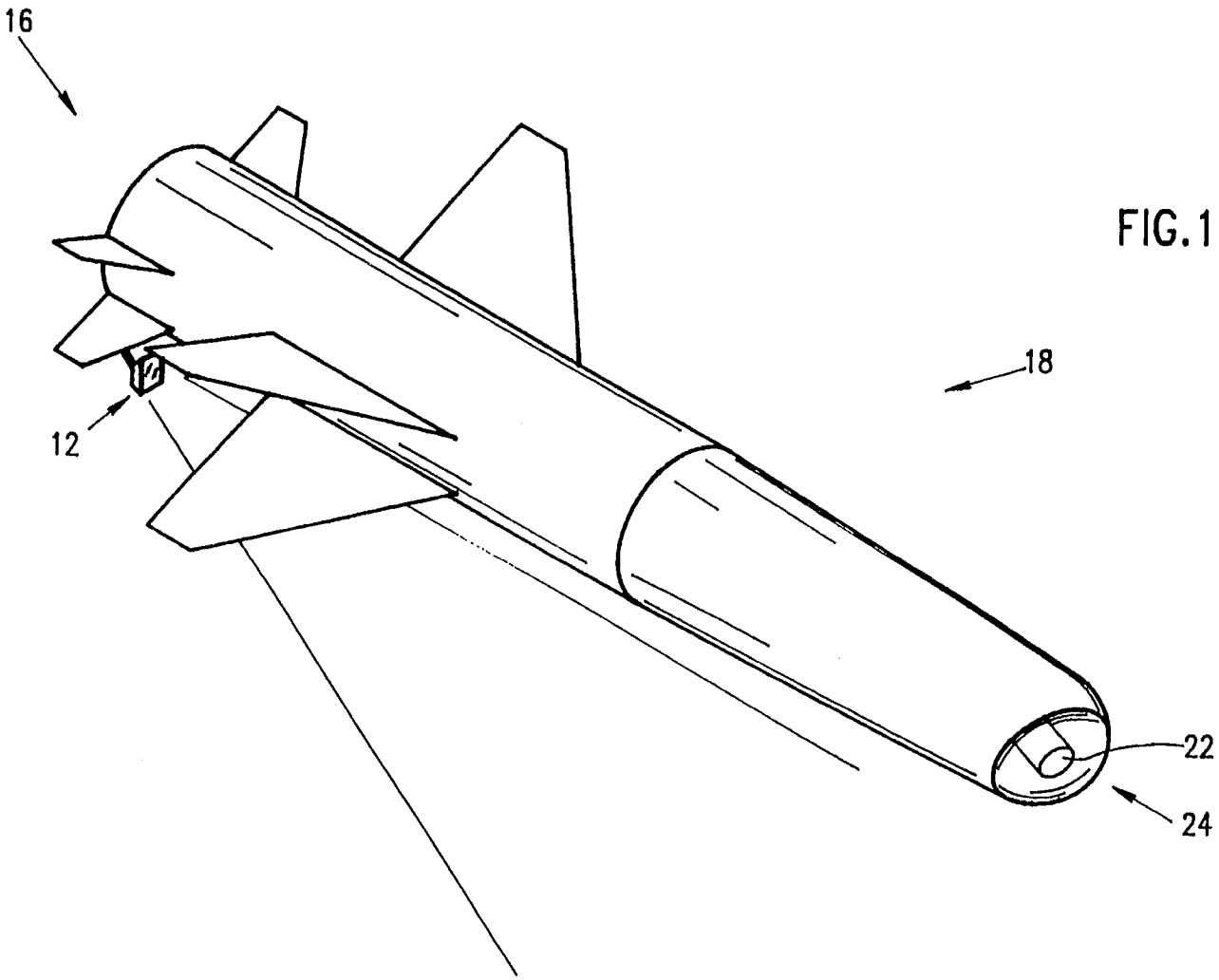
FIG. 1 is a pictorial illustration of a chassis of a typical guided weapon with an intensified CCD camera at its nose and with a high intensity light source mounted on a retractable platform located at the tail end of the chassis in accordance with a preferred embodiment of the invention.
Figure 2A:
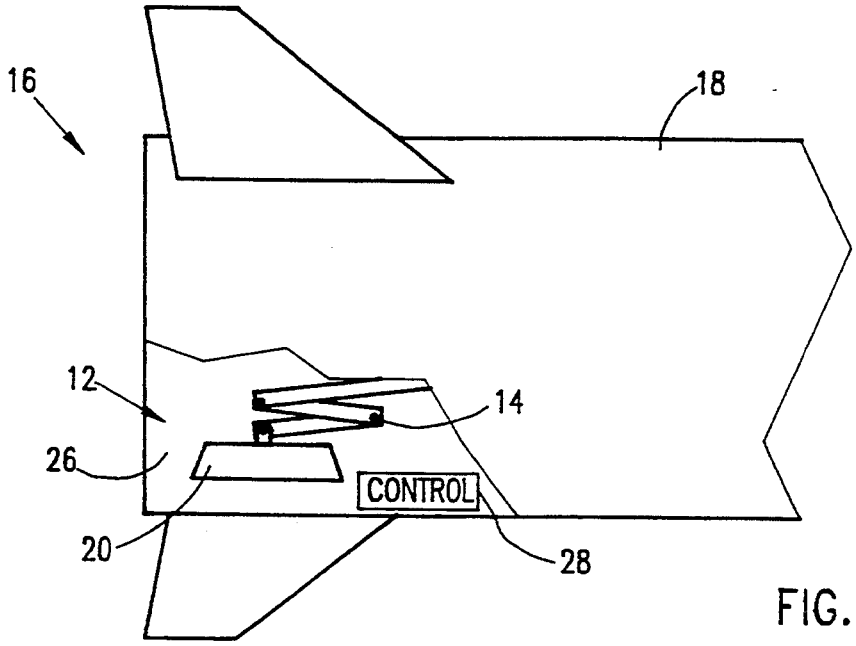
FIG. 2A is a pictorial illustration of a close up view of the retractable platform shown in FIG. 1 in its retracted state.
Figure 2B:
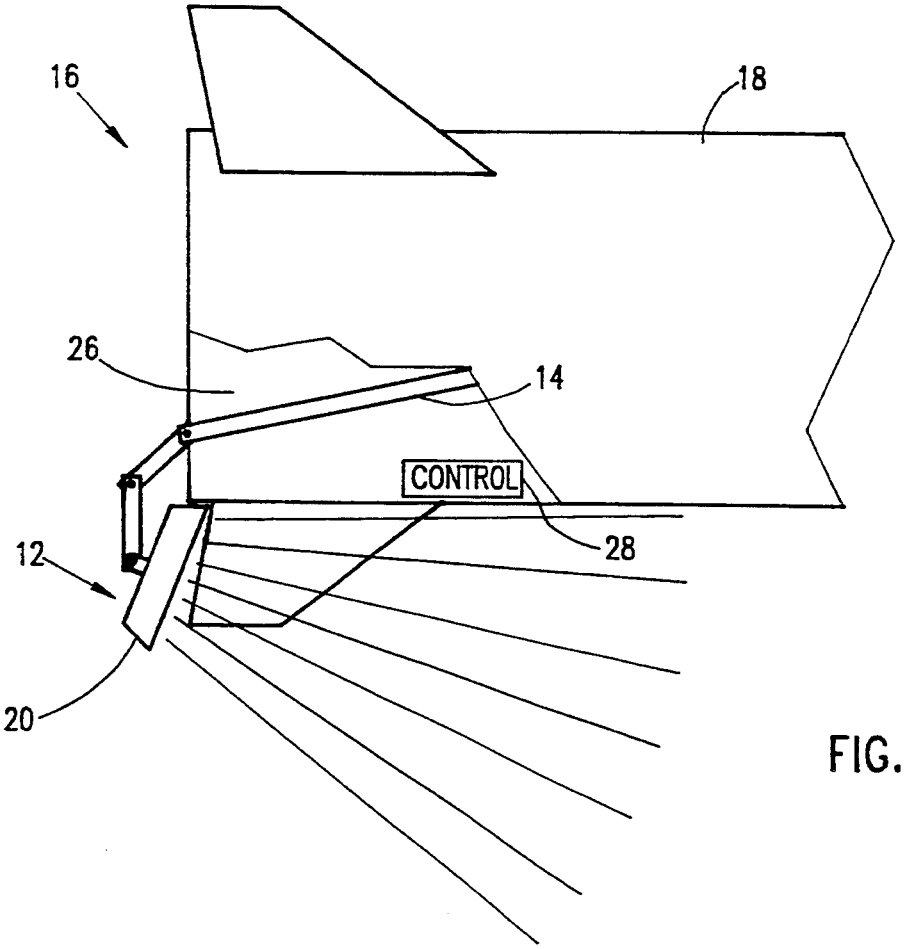
FIG. 2B is a pictorial illustration of a close up view of the retractable platform shown in FIG. 1 in its extended state.

Reference is now made to FIGS. 1, 2A and 2B. FIG. 1 provides a pictorial illustration of a guided weapon chassis. FIGS. 2A and 2B show a high intensity light source mounted on a retractable platform located at a tail end of the chassis, the platform being in a retracted and in an extended state respectively. In the preferred embodiment shown in FIG. 1, the weapon is an airborne guided missile.

In a preferred embodiment of the invention a platform 12 supported by a collapsible arm 14 is built into a tail end 16 of a guided weapon 18. While mounting at the tail end of the missile is shown in FIG. 1, other mounting positions are possible. The determination of the point of mounting in a particular situation is based on aerodynamic/hydrodynamic and operational considerations.

A high intensity light source 20 is typically mounted on platform 12. An intensified CCD camera 22 is typically mounted within a nose 24 of a guided weapon 18. In a preferred embodiment of the invention an intensified CCD camera having a sensitivity threshold of about $10^{-6}$ lux and a light source with a luminous intensity of 400,000 cd or more are utilized.

In its retracted position the chassis is recessed in a niche 26 under the surface of weapon 18, thereby preserving the aerodynamics/hydrodynamics of the weapon and protecting light source 20 when it is not in use.

A seeker with a lower threshold such as one utilizing intensified CCD camera 22 is therefore operative to extend the range of operation under poor lighting condition over that available with ordinary CCD or video cameras.

In a preferred embodiment of the invention, when scene illuminance falls under $10^{-5}$ lux, the image provided by intensified CCD camera 22 mounted on weapon 18 may no longer be usable. Under such circumstances a control device 28 activates a motor or other such device (not shown) to extend collapsible arm 14 and drive platform 12 out to an extended predetermined position as shown in FIG. 2B. In conjunction with this extension operation, control device 28 also activates a second motor or other such device (not shown) to orient platform 12 such that light source 20 faces toward the target area. When platform 12 is extended and oriented, under low light conditions, control device 28 activates high intensity light source 20 mounted on platform 12 to illuminate the area viewed by intensified CCD camera 22.

In an alternate preferred embodiment of the invention, the light source is pointed away from the target for decoy purposes.

While the above description dwells on the most likely use of the invention, other modes of operation are possible. Under some modes, control device 28 activates the motors extending collapsible arm 14 or orienting platform 12, upon command. Also, control device 28 can activate high intensity light source 20 upon command. Thus, platform 12 can be extended out or retracted and light source 20 can be activated or turned off, at any time. Likewise platform 12 can be oriented in any direction. The latter features enable e.g., scanning of areas other then target areas, marking an area or a path or provide deception or avoidance capabilities.

The employment of the preferred intensified CCD camera and a 400,000 cd illuminating source in a preferred embodiment of the invention enables the weapon to distinguish a target from its surroundings from as far away as 10 km when natural lighting conditions are under $10^{-4}$ lux. This is in comparison to a distance of only 2 km if the standard camera was operated with the above illumination. If no illumination were provided, the distances would be much smaller.

While intensified CCD cameras are ideal for use in low light conditions, they may have reduced performance in normal daylight conditions. In a preferred embodiment of the invention an additional CCD or video camera is situated in the chassis, for example in the nose cone, and is activated in place of the intensified CCD camera when lighting conditions are higher than those suitable for the intensified camera. Alternatively, filters are provided for covering the input to the intensified CCD camera during such high ambient light conditions, thereby reducing the light levels to the intensified CCD camera to optimum levels.

It will be appreciated by persons skilled in the art that the present invention is not limited by the description and example provided hereinabove. Rather, the scope of this invention is defined only by the claims which follow:

I claim:

1. A day/night guided weapon comprising:

a chassis;

a guided chassis driver operative to provide guided driving of the chassis;

an intensified CCD camera mounted on the chassis for providing optical target acquistion;

a retractable platform mounted on the chassis for mounting auxiliary guiding or target acquisition equipment; and a light source mounted on the chassis for providing illumination of at least a selected area of the target, wherein the light source has an intensity sufficient to illuminate the selected area to the extent required for the camera to provide an image of the selected area, and wherein the light source is mounted on the retractable platform.

2. Apparatus according to claim 1 wherein the retractable platform is retractable so as to reduce drag on the guided weapon.

3. Apparatus according to claim 1 wherein the retractable platform is retractable so as to protect the light source.

4. Apparatus according to claim 1 wherein the retractable platform is extendible so as to facilitate orientation of the platform.

5. Apparatus according to claim 1 and also including an extending mechanism associated with the retractable platform and also including means for activating the extending mechanism of the retractable platform according to commands.

6. Apparatus according to claim 5 wherein the means for activating the extending mechanism of the retractable platform is operative for extending the platform when the target scene illuminance falls below a predetermined level.

7. Apparatus according to claim 6 and also including a light source activator operative to activate the light source according to commands.

8. Apparatus according to claim 7 and also including a light source activator operative to activate the light source when the target scene illuminance falls below a predetermined level.

9. Apparatus according to claim 7 and also including a second camera adapted for tracking during daylight.

10. Apparatus according to claim 7 wherein the guided weapon is an airborne weapon.

11. Apparatus according to claim 6 and also including a second camera adapted for tracking during daylight.

12. Apparatus according to claim 6 wherein the light source activator includes a light source director operative to direct the light source towards the bearing of at least one camera.

13. Apparatus according to claim 6 wherein the light source activator includes a light source director operative to direct the light source away from the bearing of at least one camera for deception purposes.

14. Apparatus according to claim 6 wherein the guided weapon is an airborne weapon.

15. A day/night guided weapon comprising:

a chassis;

a guided chassis driver operative to provide guided driving of the chassis;

an intensified CCD camera mounted on the chassis for providing optical target acquisition;

a light source mounted on the chassis for providing illumination of at least a selected area of the target, wherein the light source has an intensity sufficient to illuminate the selected area to the extent required for the camera to provide an image of the selected area; and a light source activator operative to activate the light source when the target scene illuminance falls below a predetermined level.

* * * * *